US009590753B2

(12) United States Patent
Agnihotri et al.

(10) Patent No.: US 9,590,753 B2
(45) Date of Patent: Mar. 7, 2017

(54) METHOD AND APPARATUS FOR MULTIPLE MEDIA OUTPUT

(71) Applicant: SONY CORPORATION, Tokyo (JP)

(72) Inventors: Tanmay Agnihotri, San Diego, CA (US); Guru Balasubramanian, San Diego, CA (US); Kalyana Kota, San Diego, CA (US); Srivastava Nanduri, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 845 days.

(21) Appl. No.: 13/630,162

(22) Filed: Sep. 28, 2012

(65) Prior Publication Data

US 2014/0094112 A1 Apr. 3, 2014

(51) Int. Cl.
*H04H 40/00* (2009.01)

(52) U.S. Cl.
CPC ..... *H04H 40/00* (2013.01)

(58) Field of Classification Search
CPC ..... H04L 12/2838; H04L 1/189; H04L 2001/0093; H04L 2012/2841; H04L 29/06027; H04L 65/607; H04L 25/0204; H04L 45/44; H04L 5/0048; H04L 65/4076; H04L 65/608; H04L 67/38; H04W 84/18; H04W 92/02; H04W 12/06
USPC ..... 455/3.06, 3.02, 3.03, 428, 432.1, 435.1, 455/455, 464; 370/310, 328, 352, 432; 348/588; 381/311; 463/42
See application file for complete search history.

(56) References Cited

U.S. PATENT DOCUMENTS

| | | | | |
|---|---|---|---|---|
| 6,704,060 | B2 | 3/2004 | Levandowski | |
| 7,664,856 | B2 | 2/2010 | Bowra et al. | |
| 2004/0150530 | A1 | 8/2004 | Haruki | |
| 2008/0025535 | A1* | 1/2008 | Rajapakse | 381/311 |
| 2010/0306401 | A1* | 12/2010 | Gilson | 709/231 |

* cited by examiner

*Primary Examiner* — Shaima Q Aminzay
(74) *Attorney, Agent, or Firm* — Chip Law Group

(57) ABSTRACT

Certain aspects of an apparatus and method for multiple media output may include a network comprising one or more media rendering devices communicably connected to a media manager. The media manager may be operable to separate a received single media signal into a first channel carrying a first content and a second channel carrying a second content. The media manager may be operable to wirelessly transmit first content via the first channel to a first media rendering device of the one or more media rendering devices and second content via the second channel to a second media rendering device of the one or more media rendering devices.

18 Claims, 6 Drawing Sheets

METHOD AND APPARATUS FOR MULTIPLE MEDIA OUTPUT

CROSS-REFERENCE TO RELATED APPLICATIONS/INCORPORATION BY REFERENCE

None.

FIELD

Certain embodiments of the disclosure relate to media rendering devices. More specifically, certain embodiments of the disclosure relate to a method and apparatus for multiple media output in media rendering devices.

BACKGROUND

Advancements in technology of multimedia content delivery have seen tremendous improvements in the recent years. The various abilities of media servers have catered to advanced media viewing and/or playing experience via a media rendering device for a user. For example, a user may experience two channels (e.g. audio, video) on the same media rendering device. In certain scenarios, the experience of rendering multiple channels on a single media rendering device may have associated limitations. For example, if the two channels correspond to audio content, then the single audio output of the media rendering device may be a mix of two individual audio signals. Hence, a user may not be able to listen to both the channels simultaneously due to mixing of two audio signals.

Further limitations and disadvantages of conventional and traditional approaches will become apparent to one of skill in the art, through comparison of such systems with some aspects of the present disclosure as set forth in the remainder of the present application with reference to the drawings.

SUMMARY

An apparatus and/or method is provided for multiple media output substantially as shown in and/or described in connection with at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Certain implementations may be found in an apparatus and/or method for multiple media output. Exemplary aspects of the disclosure may comprise a network that comprises one or more media rendering devices communicably connected to a media manager. The media manager may be operable to receive a single media signal from one or both of a content source and/or a local memory. The media manager may be operable to separate the received single media signal into a first channel that carries a first content and a second channel that carries a second content. The media manager may wirelessly transmit the first content via the first channel to a first media rendering device of the one or more media rendering devices and the second content via the second channel to a second media rendering device of the one or more media rendering devices. Hereinafter, the terms "transmitting the first content via the first channel" is also referred to as "transmitting the first channel", and the terms "transmitting the second content via the second channel" is also referred to as "transmitting the second channel"). Further, the first content may be displayed and/or played on the first media rendering device and the second content may be displayed and/or played on the second media rendering device. The first content and the second content may correspond to one or more of audio data, video data, text data, and/or web content. The media manager may buffer the first content corresponding to the first channel and/or the second content corresponding to the second channel prior to transmission. The transmission of the first channel and/or the second channel may be based on user configurable settings.

In an embodiment, the media manager may be operable to register the one or more media rendering devices to receive the first channel and the second channel. In an embodiment, the media manager may be operable to receive rendering capabilities of the one or more media rendering devices. The rendering capabilities may be one or more of a supported transfer protocol, a supported data format, and/or information regarding controlling flow of content. The media manager may be auto-configured based on the received rendering capabilities.

Figure 1:
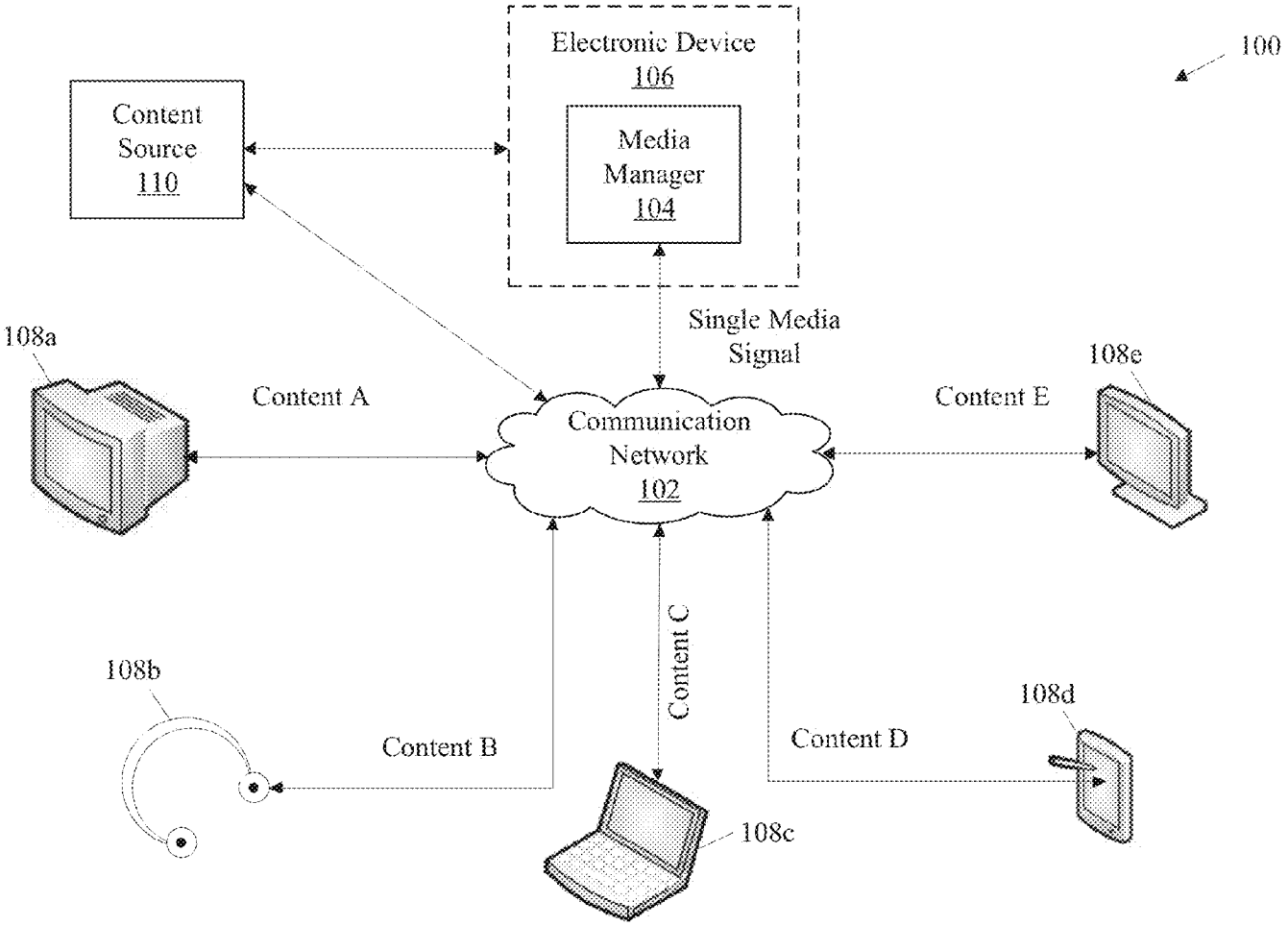
FIG. 1 is a block diagram illustrating a network environment for multimedia output to multiple media rendering devices, in accordance with an embodiment of the disclosure.

FIG. 1 is a block diagram illustrating a network environment for multimedia output to multiple media rendering devices, in accordance with an embodiment of the disclosure. Referring to FIG. 1, there is shown a network 100 and a content source 110. The network 100 may include a media manager 104, an electronic device 106, and one or more media rendering devices, such as, a Television 108*a*, headphones 108*b*, a laptop 108*c*, a handheld device 108*d*, a monitor 108*e*. The one or more media rendering devices may be collectively referred to as "media rendering device 108". Further, headphones 108*b* may be wired headphones or wireless headphones. Notwithstanding, the disclosure may not be so limited, and other media rendering devices may be utilized without limiting the scope of the disclosure.

The media manager 104 may communicate with the electronic device 106 and/or the media rendering device 108 via a communication network 102. In an embodiment, the media manager 104 may be a part of the electronic device 106. In an alternative embodiment, the media manager 104 and the electronic device 106 may be two separate devices that may be communicatively coupled to each other via the communication network 102.

The communication network 102 may correspond to a medium through which content and messages may flow between the various components (e.g. media manager 104, electronic device 106, and/or the media rendering device 108) of the apparatus environment. The communication network 102 may be enabled by one or more communication protocols which include, but are not limited to, Wireless Fidelity (Wi-Fi), Wireless Universal Serial Bus (WUSB), Local Area Network (LAN), ZigBee, TCP/IP, Ethernet, and/or Bluetooth, for example. Various components in the apparatus environment may connect to the communication network 102, in accordance with various wired and wireless communication protocols, such as, Transmission Control Protocol and Internet Protocol (TCP/IP), User Datagram Protocol (UDP), ZigBee, Infra Red (IR), IEEE 802.11a, IEEE 802.11b, IEE 802.11g, and IEEE 802.11n communication protocols.

The content source 110 may comprise suitable logic, circuitry, interfaces, and/or code that may be operable to transmit a single media signal to the media manager 104. Transmission may occur through at least one or more of a cable network, an IP network, a satellite network, and/or a Digital Subscriber Line (DSL) network. Transmission may also occur through a cellular network that employs various technologies such as, High-Speed Downlink Packet Access (HSDPA), Code Division Multiple Access X-series (CDMA-X) and/or Fourth Generation (4G) technologies.

In operation, the media manager 104 and the media rendering device 108 may be switched on and the communication network 102 may be activated (e.g., the Wi-Fi, the Bluetooth, and/or the like may be activated) on the media manager 104 and the media rendering device 108. The content source 110 may be operable to transmit a single media signal to the media manager 104. The single media signal may include content, such as audio data, video data, text data, web content, and/or a combination thereof. The media manager 104 may be operable to separate the received single media signal into at least two channels. Further, the media manager 104 may be operable to transmit a first channel to a first media rendering device and a second channel to a second media rendering device. The first media rendering device and the second media rendering device may be operable to display and/or play the first channel and/or the second channel respectively.

In an embodiment, referring to FIG. 1, Content A may be a baseball game, content B may be a live music concert, content C may be a food recipe available on a webpage, content D may be a text chat window, and Content E may be a Skype video chat, for example.

In an embodiment, the single media signal may correspond to media stored on the media manager 104. In another embodiment, the single media signal may be transmitted by the electronic device 106. In yet another embodiment, the electronic device 106 may receive the single media signal from the content source 110. Examples of electronic device 106 may include a Set-Top-Box (STB), a Television receiver, a display device, a smartphone and the like.

The content source 110 may be a content server or a broadcast station, depending on the type of network (such as the cable network, the IP network, the satellite network, the Digital Subscriber Line (DSL) network, the cellular network, and the like.) The content source 110 may transmit the single media signal to the media manager 104. The content source 110 may be one or both of a web-based server, and/or a cloud-based server.

Figure 2A:
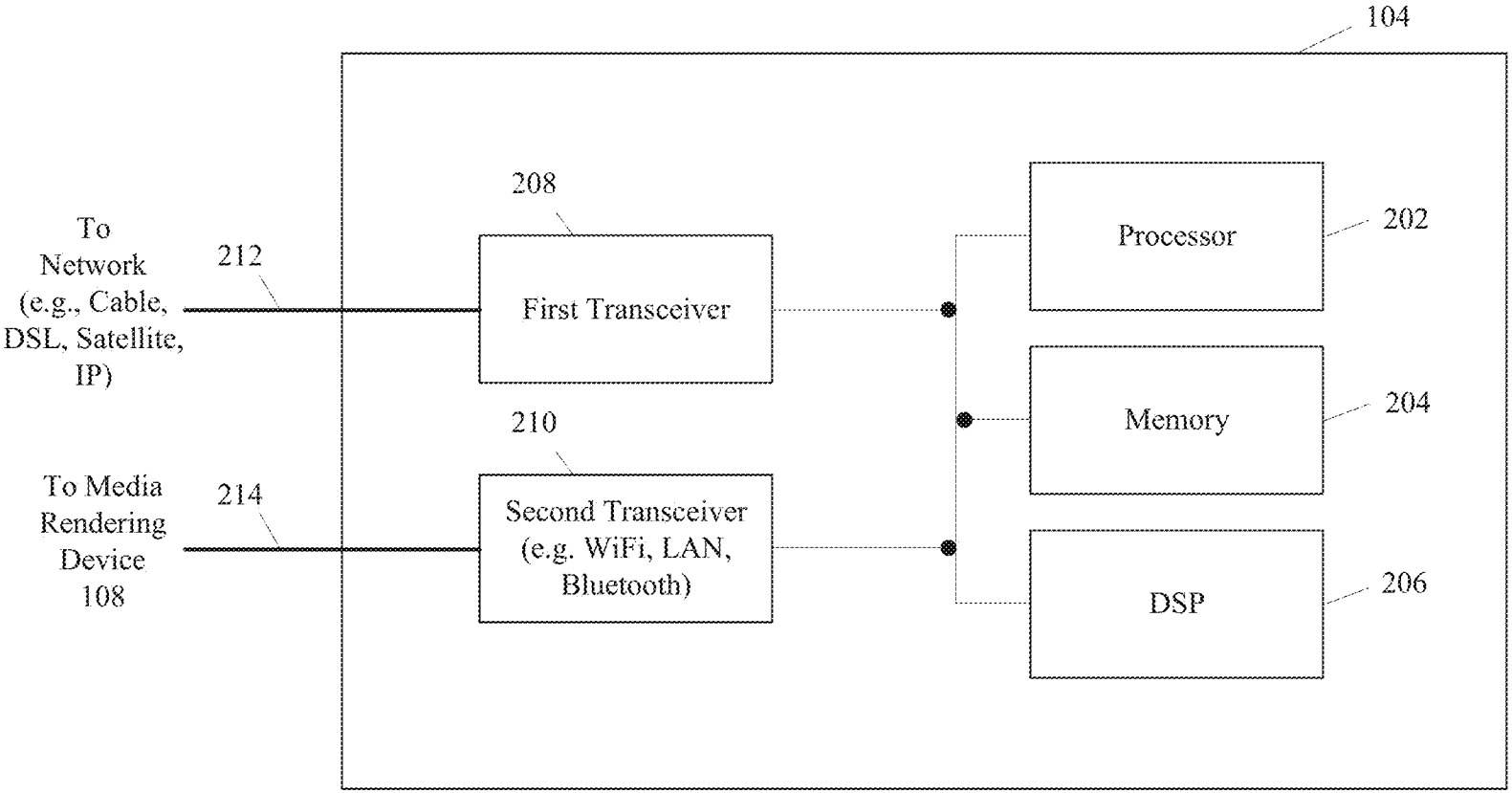
FIG. 2*a* is a block diagram illustrating a media manager, in accordance with an embodiment of the disclosure.

FIG. 2*a* is a block diagram illustrating a media manager, in accordance with an embodiment of the disclosure. FIG. 2*a* is explained in conjunction with elements from FIG. 1. The media manager 104 comprises a processor 202, a memory 204, a Digital Signal Processor (DSP) 206, a first transceiver 208, a second transceiver 210, a first communication interface 212, and a second communication interface 214.

The processor 202 may be coupled with the memory 204, and the DSP 206, the first transceiver 208 and the second transceiver 210. The first transceiver 208 via first communication interface 212 may communicate with one or more of a cable network, a (Digital Subscriber Line) DSL network, a Satellite network, and/or an Internet Protocol (IP) network, for example. The second transceiver 210 may communicate with the media rendering device 108 via second communication interface 214. The first communication interface 212 and the second communication interface 214 may be a wireless or a wired (such as a cable) interface.

The processor 202 may comprise suitable logic, circuitry, interfaces, and/or code that may be operable to execute a set of instructions stored in the memory 204. The memory 204 may be operable to store the set of instructions. The processor 202 may be implemented using one or more processor technologies known in the art. Examples of processor 202 may be an X86 processor, a RISC processor, an ASIC processor, a CISC processor, or any other processor. The processor 202 may be operable to gather the set of instructions from memory 204 and execute the set of instructions. The memory 204 may be implemented as a Random Access Memory (RAM), a Read-Only Memory (ROM), a Hard Disk Drive (HDD), and/or a secure digital (SD) card, for example.

In operation, the media manager 104 and the media rendering device 108 may be activated. When activated, the processor 202 may be operable to separate a received single media signal into a first channel that carries a first content and a second channel that carries a second content using the DSP 206. The first content and the second content may be any one of video data, audio data, text data, web content, and/or a combination thereof. Further, the processor 202 may be operable to wirelessly transmit the first channel to a first media rendering device and the second channel to a second media rendering device. In one embodiment, the transmission may occur via the second transceiver 210.

In an embodiment, the processor 202 may be operable to receive the single media signal transmitted by the content source 110 via the first transceiver 208. Alternatively, the processor 202 may be operable to receive via the first transceiver 208, the single media signal from a local memory of the electronic device 106 hosting media manager 104.

In an embodiment, the first of the one or more media rendering devices (e.g., television 108*a* or the laptop 108*c*) may display the first channel. In an alternative embodiment, the first of the one or more media rendering devices (e.g., headphones 108*b*) may play the first channel. Further, the quality of the first channel and/or the second channel may be improved by the DSP 206 before transmitting the channels.

The transmission of the first channel and the second channel may be based on user configurable settings. For example, a user may want to view the first channel (e.g., a video data) on Television 108*a* and may want to listen to the second channel (e.g., an audio data) on headphones 108*b*. In such a case, the user may employ a remote control that operates the media manager 104 to configure the settings of the media manager 104, so that the first channel may be transmitted to Television 108*a* and the second channel may be transmitted to headphones 108*b*. In an alternative embodiment, the processor may be operable to present a user interface to configure settings for the transmission and/or reception besides other user preferences. Such user preferences may include selection of the media rendering device 108 for rendering a user-preferred content in the first channel and the second channel.

In an embodiment, at least a part of such settings may be auto-configured by the processor 202 based on initial communications with the media rendering device 108. For example, at the start of operation, the media manager 104 may register the one or more media rendering devices (such as the media rendering device 108) for receiving the first channel and/or the second channel. During the registration, the media manager 104 may receive details regarding the rendering capabilities of the media rendering device 108. The rendering capabilities may correspond to one or more of a supported transfer protocol, a supported data format, and/or information regarding controlling flow of content. The details thus obtained may be stored in appropriate formats/data structures in the memory 204. Subsequently, the processor 202 may selectively transmit different channels to different media rendering devices (such as media rendering device 108) based on the individual rendering capabilities.

In another embodiment, the media manager 104 may not transmit the first channel or the second channel available in a particular format to the media rendering device 108 that does not support that particular format. For example, the media manager 104 may receive details regarding the rendering capabilities of the headphones 108*b*. Hence, the media manager 104 may not transmit a TV program (comprising video data only) to the headphones 108*b*. In an embodiment, the media manager 104 may prompt on a display screen that the first channel or the second channel is not supported by the headphones 108*b*. The display screen may be associated with one or both of the media manager 104 and/or the media rendering device 108 hosting media manager 104. Alternatively, the display screen may be associated with the electronic device 106 hosting the media manager 104.

In an embodiment where the electronic device 106 hosting the media manager 104 comprises the display screen, at least one of the first channel or the second channel may be transmitted to a first of the one or more media rendering devices (such as media rendering device 108). For example, the first channel may be displayed on the display screen and the second channel may be transmitted to the laptop 108*c*.

In an embodiment, the processor 202 may be operable to buffer the first channel and/or the second channel using the memory 204 before transmission. Buffering may help in delaying the time taken in transmitting the first channel and/or the second channel. Therefore, the user may have time to configure the settings for reception of the first channel and/or the second channel at a preferred media rendering device 108. Further, buffering may provide time for the user to select a desired audio and/or video stream from one or more audio and video streams for transmission.

In another embodiment, the first transceiver 208 may connect to the electronic device 106 via the first communication interface 212. The electronic device 106 may, in turn, connect to one or more of the Cable network, the DSL network, the Satellite network, the IP network, and/or the cellular network, for example.

The processor 202 may utilize an operating system stored in memory 204 that includes at least one of a Bluetooth connection stack or a Linux based stack, but may not be so limited.

The single media signal may be received from a content source 110. Alternatively, the single media signal may correspond to a media stored in the media manager 104.

In an embodiment, transmission of the first channel and/or the second channel may occur when the media manager 104 and the one or more media rendering devices (such as laptop 108*c*) may be in communicable range. The communicable range may depend on the communication network 102 (e.g. the Wi-Fi, the Bluetooth, and the like) that may be used. Alternatively, the media manager 104 may stop transmission of the first channel and/or the second channel when the media manager 104 and the one or more media rendering devices (such as laptop 108*c*) may not be in the communicable range. However, transmission of the first channel and/or the second channel may resume when the media manager 104 and the laptop 108*c* may come back within the communicable range.

Figure 2B:
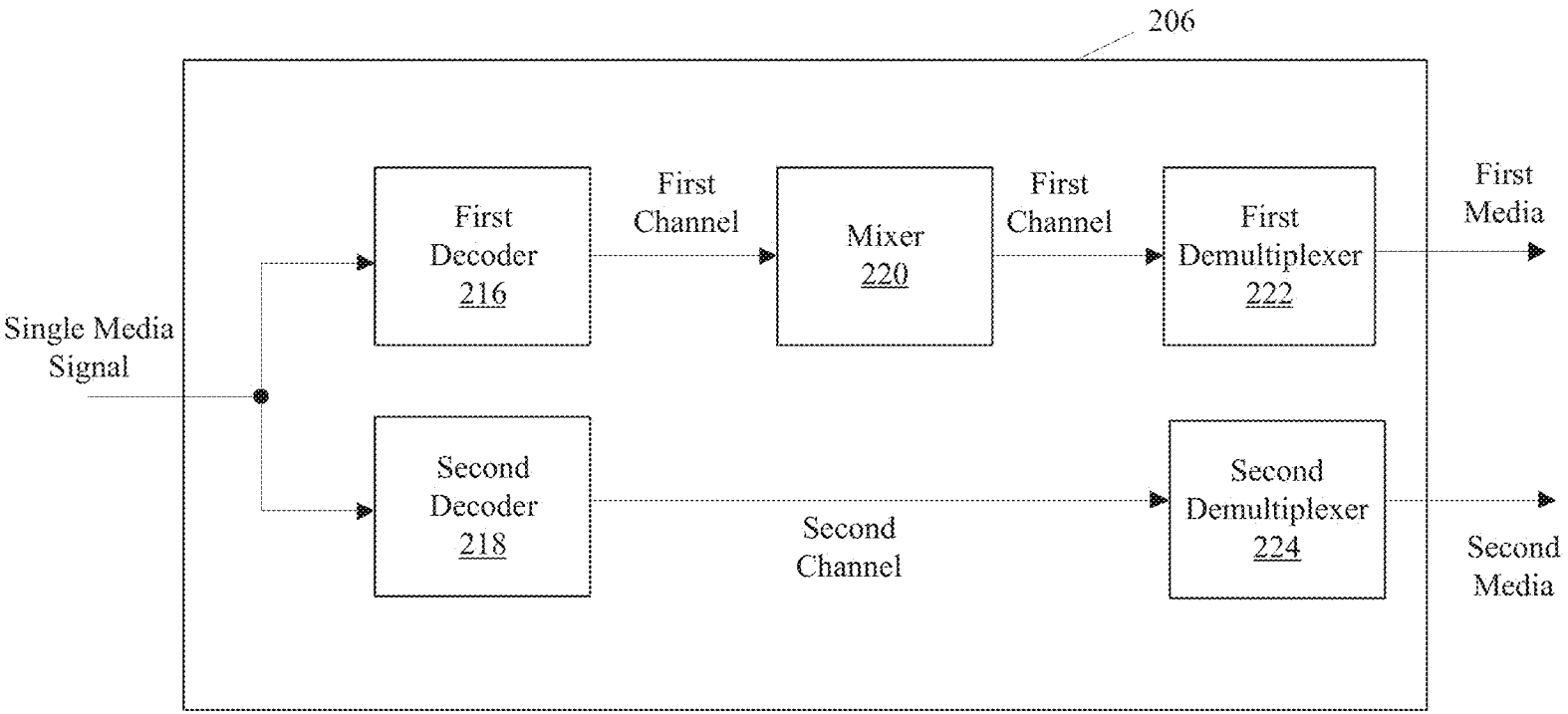
FIG. 2*b* is a block diagram illustrating a Digital Signal Processor (DSP) in a media manager, in accordance with an embodiment of the disclosure.

FIG. 2*b* is a block diagram illustrating a Digital Signal Processor (DSP) in a media manager, in accordance with an embodiment of the disclosure. FIG. 2*b* is explained in conjunction with elements from FIG. 1, and FIG. 2*a*. The DSP 206 may comprise one or more decoders, one or more demultiplexers, and a mixer. Referring to FIG. 2*b*, there is shown the DSP 206 comprising a first decoder 216, a second decoder 218, a mixer 220, a first demultiplexer 222, and a second demultiplexer 224. The first decoder 216 and the second decoder 218 may decode the received single media signal (available in packets) into a first channel and a second channel, respectively. Subsequently, the first channel may be transmitted to the mixer 220 and then to the first demultiplexer 222. The second channel may be directly transmitted to the second demultiplexer 224 without passing through the mixer 220. Further, the first demultiplexer 222 may output a first media carried by the first channel and the second demultiplexer 224 may output the second media carried by the second channel. As per the user configured settings, at least one of the first media or the second media may be transmitted to the media rendering device 108 for display.

Figure 3:
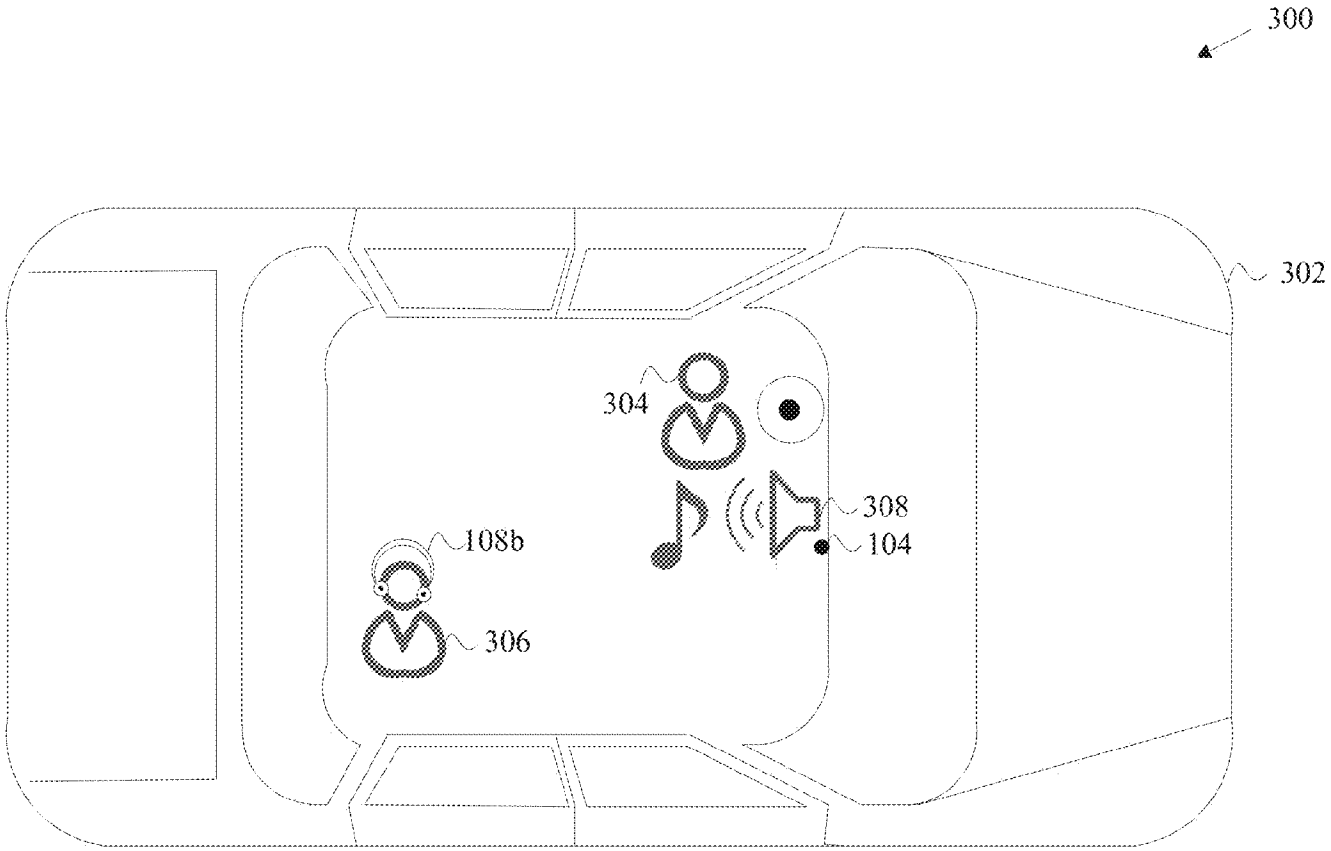
FIG. 3 is a diagram illustrating an example implementation of an apparatus for communication in a vehicle, in accordance with an embodiment of the disclosure.

FIG. 3 is a diagram 300 illustrating an example implementation of an apparatus for communication in a vehicle, in accordance with an embodiment of the disclosure. FIG. 3 is explained in conjunction with elements from FIG. 1. Referring to FIG. 3, there is shown a vehicle 302, a first passenger 304, a second passenger 306, a media player 308, and headphones 108*b*.

The media player 308, associated with the vehicle 302, may be embodied with the capabilities of the media manager 104. Further, built-in speakers may be connected to the media player 308. The headphones 108*b* may be connected to the media player 308.

In operation, the media player 308 and headphones 108*b* may be activated. It may be desirable that the first passenger 304 and the second passenger 306 may want to listen to a first audio music channel and a second audio music channel, respectively. The media manager 104 may separate a received single media signal into a first audio music channel and a second audio music channel. The single media signal may be received from one or both of the content source 110 and/or a local memory, for example. Further, according to the configuration performed on the media manager 104 by the user, the first audio music channel and the second audio music channel may be output using the in-built speakers and headphones 108*b*, respectively. Therefore, the first passenger 304 and the second passenger 306 may be able to listen to two different audio music channels at the same time.

In an embodiment, the media player 308 may be a multi-disk media player that may play different disks or content for different passengers in the vehicle 302. Different passengers in the vehicle 302 may use individual sets of headphones (e.g. the headphones 108*b*), or there may be in-seat speakers built for different passengers.

In another embodiment, video channels may be displayed on one or more display devices in the vehicle 302. In such a case, the first passenger 304 and the second passenger 306 may utilize at least two display devices among the one or more display devices in order to view the video channels.

Figure 4:
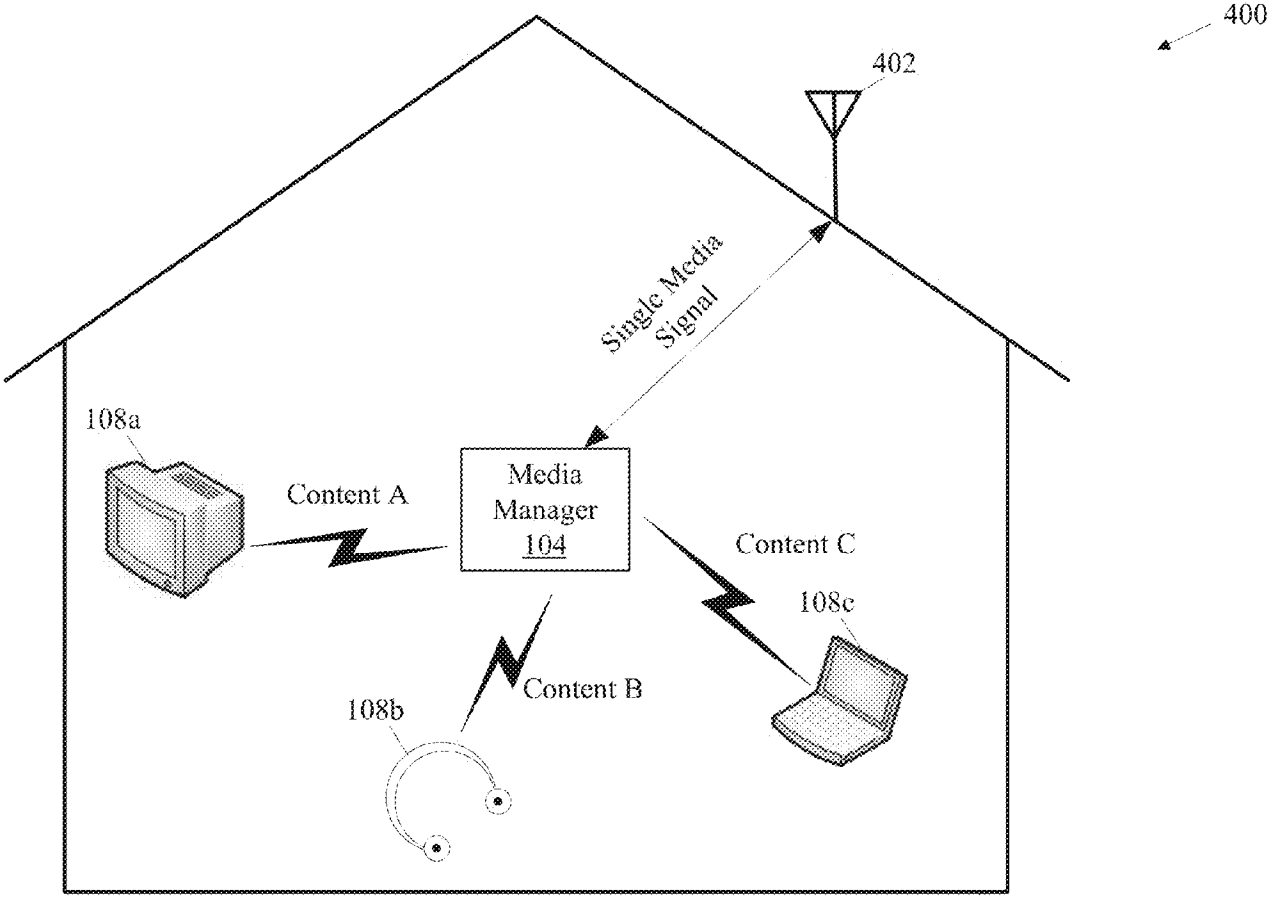
FIG. 4 is a diagram illustrating another example implementation of an apparatus for communication in a home environment, in accordance with an embodiment of the disclosure.

FIG. 4 is a diagram illustrating another example implementation of an apparatus for communication in a home environment, in accordance with an embodiment of the disclosure. FIG. 4 is explained in conjunction with elements from FIG. 1. Referring to FIG. 4, there is shown a home environment 400 that includes an antenna 402, the media manager 104, the Television 108*a*, the headphones 108*b*, and the laptop 108*c*.

The Television 108*a*, the headphones 108*b*, and the laptop 108*c* may be communicably connected to the media manager 104. The media rendering device 108 and the media manager 104 may be communicably connected via a wireless and/or a wired medium.

In operation, the media manager 104 may be activated and a received single media signal may be separated into a first channel and a second channel. Based on the user configured settings, at least one of the first channel and/or the second channel may be transmitted to at least two of the one or more media rendering devices (such as the media rendering device 108). Accordingly, a content A may be displayed on the Television 108*a*, a content B may be played on the headphones 108*b*, and a content C may be displayed on the laptop 108*c*.

In an embodiment, the antenna 402 may transmit the single media signal to the media manager 104. Alternatively, the single media signal may be transmitted by a satellite dish.

In an embodiment, content A may be a baseball game, content B may be a live music concert, and content C may be a food recipe. Accordingly, different people in different rooms of the home environment 400 may be able to listen to/watch a desired content without interfering with the others' desired content.

The disclosed embodiments may be embodied in a home theatre system that may have a capability to execute at least two Digital Video Discs (DVDs) at an instance. In such instances, the media manager 104 embodied in the home theatre system may decode and display a first DVD of the at least two DVDs to a first user at a first location and a second DVD of the at least two DVDs to a second user at a second location. Accordingly, two different contents may be watched by two different people at two different locations at the same time.

Figure 5:
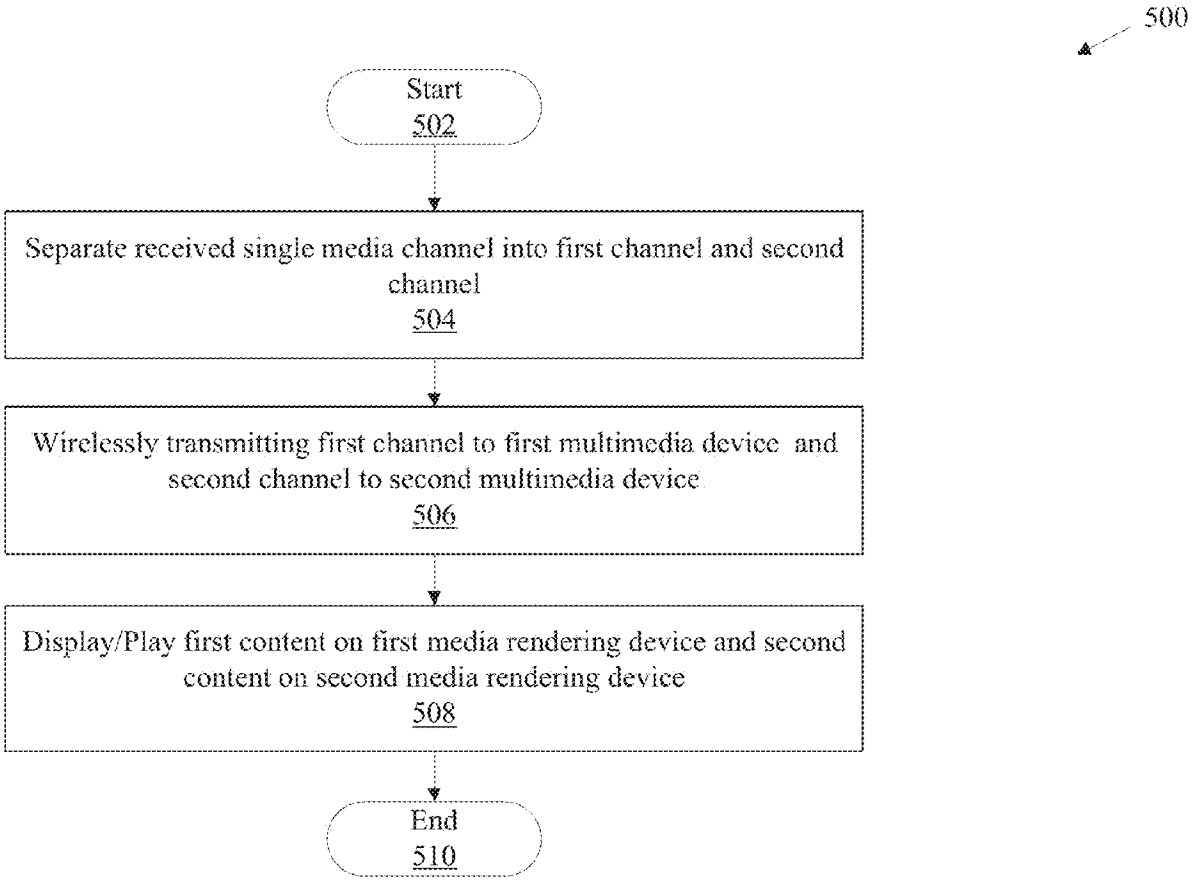
FIG. 5 is a flow chart illustrating a method for multimedia output to multiple media rendering devices, in accordance with an embodiment of the disclosure.

FIG. 5 is a flow chart 500 illustrating a method for multimedia output to multiple rendering devices, in accordance with an embodiment of the disclosure. Referring to FIG. 5, there is shown a method 500. The method 500 is explained in conjunction with elements from FIG. 1.

Exemplary steps may begin at step 502 and a control may pass to step 504. At step 504, a received single media signal may be separated into a first channel carrying a first content and a second channel carrying a second content. Upon separation, the control may pass to step 506. At step 506, the first channel may be wirelessly transmitted to a first media rendering device, of one or more media rendering devices, and the second channel may be wirelessly transmitted to a second media rendering device of the one or more media rendering devices. Upon transmitting the first channel and the second channel, the control may pass to step 508. At step 508, the first content may be displayed and/or played on the first media rendering device and the second content may be displayed and/or played on the second media rendering device. The method 500 ends at step 510.

In an embodiment, the disclosed embodiments may be implemented on various platforms, such as Android, Bravia Internet Video Link Television (BVLTV), iOS, and the like. Further, the disclosed embodiments may be implemented on any device operating system that utilizes at least one of a Bluetooth connection stack or a Linux stack.

In accordance with another embodiment, the media manager 104 may reside on the media rendering device 108. Further, the disclosed embodiments may be implemented at the middleware layer of the chipsets. Accordingly, there may not be a necessity for adhering to specific protocols for demultiplexing and/or decoding.

In accordance with another embodiment of the disclosure, a method and apparatus for multiple media output may comprise a network 100 (FIG. 1) comprising one or more media rendering devices 108 (FIG. 1) communicably connected to a media manager 104 (FIG. 1). One or more processors and/or circuits, for example, processor 202 (FIG. 2*a*) in the media manager 104 may be operable to separate a single media signal into a first channel carrying a first content and a second channel carrying a second content. The media manager 104 may be operable to wirelessly transmit at least one of the first channel or the second channel to a first of the one or more media rendering devices. Examples of one or more media rendering devices 108 may be one or more of a television 108*a*, headphones 108*b*, a laptop 108*c*, a personal computer 108*e*, a Personal Digital Assistant (PDA), a smartphone, a playback device, a handheld device 108*d*, and/or a display device. In an embodiment, the media manager 104 may be operable to transmit the first channel and/or the second channel based on user configurable settings. The media manager 104 may be operable to display and/or play the channel, other than the transmitted channel on a display screen associated with the media manager 104.

In an embodiment, the media manager 104 may be operable to demultiplex the first channel and the second channel. In another embodiment, the media manager 104 may be operable to buffer the first channel and/or the second channel prior to transmission.

Other embodiments of the disclosure may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps comprising a media manager communicably connected to one or more media rendering devices. A received single media signal may be separated into a first channel carrying a first content and a second channel carrying a second content. The first channel may be wirelessly transmitted to the first media rendering device, for example, headphones 108*b* of the one or more media rendering devices 108 and the second channel may be wirelessly transmitted to a second media rendering device, for example, a laptop 108*c* of the one or more media rendering devices 108. The transmission of the first channel and/or the second channel may be based on user configurable settings. The first channel and/or the second channel may be buffered prior to transmission. The rendering capabilities of the one or more media rendering devices 108 may be received, which may include one or more of a supported transfer protocol, a supported data format, and/or information regarding controlling flow of content.

Accordingly, the present disclosure may be realized in hardware, or a combination of hardware and software. The present disclosure may be realized in a centralized fashion in at least one computer system or in a distributed fashion where different elements may be spread across several interconnected computer systems. Any kind of computer system or other apparatus adapted for carrying out the methods described herein may be suited. A combination of hardware and software may be a general-purpose computer system with a computer program that, when being loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features enabling the implementation of the methods described herein, and which when loaded in a computer system is able to carry out these methods. Computer program, in the present context, means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method for communication, the method comprising:

in a media manager communicably connected to one or more media rendering devices:

receiving rendering capabilities of said one or more media rendering devices;

separating a received single media signal into a first channel and a second channel based on sources of content, wherein said first channel carries a first content of a first content source and said second channel carries a second content of a second content source; and wirelessly transmitting said first content of said first content source via said first channel to a first media rendering device of said one or more media rendering devices and said second content of said second content source via said second channel to a second media rendering device of said one or more media rendering devices based on said received rendering capabilities of said first media rendering device and said second media rendering device, wherein said first content of said first content source and said second content of said second content source are simultaneously rendered by said first media rendering device and said second media rendering device, respectively.

2. The method of claim 1, comprising receiving said single media signal from one or both of: an external content source or a local memory.

3. The method of claim 1, further comprising registering said one or more media rendering devices to receive content via said first channel and said second channel.

4. The method of claim 1, wherein said received rendering capabilities correspond to one or more of: a supported transfer protocol, a supported data format, or information regarding controlling flow of content.

5. The method of claim 1, further comprising auto-configuring said media manager based on said received rendering capabilities.

6. The method of claim 1, further comprising buffering said first content of said first content source corresponding to said first channel or said second content of said second content source corresponding to said second channel prior to said transmission.

7. The method of claim 1, wherein said transmitting of said first content of said first content source via said first channel or said second content of said second content source via said second channel is based on user configurable settings.

8. The method of claim 1, wherein said first content of said first content source and said second content of said second content source corresponds to one or more of: audio data, video data text data, or web content.

9. An apparatus for communication, the apparatus comprising:

in a network that comprises one or more media rendering devices communicably connected to a media manager, one or more processors in said media manager operable to:

receive rendering capabilities of said one or more media rendering devices;

separate a received single media signal into a first channel and a second channel based on sources of content, wherein said first channel carries a first content of a first content source and said second channel carries a second content of a second content source; and wirelessly transmit said first content of said first content source via said first channel to a first media rendering device of said one or more media rendering devices and said second content of said second content source via said second channel to a second media rendering device of said one or more media rendering devices based on said received rendering capabilities of said first media rendering device and said second media rendering device, wherein said first content of said first content source and said second content of said second content source are simultaneously rendered by said first media rendering device and said second media rendering device, respectively.

10. The apparatus of claim 9, wherein said one or more processors are operable to transmit said first content of said first content source via said first channel or said second content of said second content source via said second channel based on user configurable settings.

11. The apparatus of claim 9, wherein said received rendering capabilities correspond to one or more of: a supported transfer protocol, a supported data format, or information related to control of flow of content.

12. The apparatus of claim 9, wherein said one or more processors are operable to demultiplex said first content of said first content source that corresponds to said first channel and said second content of said second content source that corresponds to said second channel.

13. The apparatus of claim 9, wherein said one or more processors are operable to buffer said first content of said first content source that corresponds to said first channel or said second content of said second content source that corresponds to said second channel prior to said transmission.

14. The apparatus of claim 9, wherein said one or more media rendering devices comprises one or more of: a television, headphones, a laptop, a personal computer, a Personal Digital Assistant (PDA), a smartphone, a playback device, a handheld device or a display device.

15. A non-transitory computer-readable storage medium having stored thereon a set of computer-executable instructions executable by a computer for causing the computer to perform operations, comprising:

in a media manager communicably connected to one or more media rendering devices:

receiving rendering capabilities of said one or more media rendering devices;

separating a received single media signal into a first channel and a second channel based on source of content, wherein said first channel carries a first content of a first content source and said second channel carries a second content of a second content source; and wirelessly transmitting said first content of said first content source via said first channel to a first media rendering device of said one or more media rendering devices and said second content of said second content source via said second channel to said second media rendering device of said one or more media rendering devices based on said received rendering capabilities of said first media rendering device and said second media rendering device, wherein said first content of said first content source and said second content of said second content source are simultaneously rendered by said first media rendering device and said second media rendering device, respectively.

16. The non-transitory computer-readable storage medium of claim 15, further comprising instructions for transmitting said first content of said first content source or said second content of said second content source based on user configurable settings.

17. The non-transitory computer-readable storage medium of claim 15, further comprising instructions for buffering said first content of said first content source corresponding to said first channel or said second content of said second content source corresponding to second channel prior to said transmission.

18. The non-transitory computer-readable medium of claim 15, wherein said received rendering capabilities correspond to one or more of: a supported transfer protocol, a supported data format, or information regarding controlling flow of content.

* * * * *